United States Patent [19]

Goudy, deceased

[11] Patent Number: 4,513,869

[45] Date of Patent: Apr. 30, 1985

[54] PEDESTAL CRANE MOUNTING SYSTEM

[75] Inventor: William E. Goudy, deceased, late of Gainesville, Tex., by Ruth Goudy, administrator

[73] Assignee: Armco, Inc., Middletown, Ohio

[21] Appl. No.: 611,116

[22] Filed: May 17, 1984

Related U.S. Application Data

[63] Continuation of Ser. No. 348,028, Feb. 11, 1982, abandoned.

[51] Int. Cl.[3] ..... B66C 23/84

[52] U.S. Cl. ..... 212/175; 212/239; 212/247; 212/253; 384/453

[58] Field of Search ..... 212/179, 181, 245–248, 212/253, 223, 192, 195, 239; 308/174, 194

[56] References Cited

U.S. PATENT DOCUMENTS

| | | | |
|---|---|---|---|
| 3,739,652 | 6/1973 | Caldwell et al. | 212/247 |
| 3,955,493 | 5/1976 | Hany et al. | 308/174 |
| 4,006,946 | 2/1977 | Mann et al. | 308/194 |
| 4,061,230 | 12/1977 | Goss et al. | 212/253 |
| 4,129,343 | 12/1978 | Sanssen | 308/194 |
| 4,184,600 | 1/1980 | Goss et al. | 212/175 |
| 4,209,210 | 6/1980 | Blomqvist et al. | 308/194 |
| 4,216,870 | 8/1980 | Bonneson et al. | 212/223 |
| 4,231,699 | 11/1980 | Thompson | 212/247 |
| 4,310,277 | 1/1982 | Robinson | 212/192 |

FOREIGN PATENT DOCUMENTS

| | | | |
|---|---|---|---|
| 39676 | 2/1916 | Sweden | 212/253 |

*Primary Examiner*—Trygve M. Blix
*Assistant Examiner*—Stephen P. Avila
*Attorney, Agent, or Firm*—Arnold, White & Durkee

[57] ABSTRACT

A pedestal crane mounting system utilizes a spherical thrust bearing, for vertically supporting the crane gantry on the pedestal, and a spherical radial bearing, for eliminating radial loading on the thrust bearing. The upper race of the spherical thrust bearing and the outer race of the spherical radial bearing have common points of origin for the generatrices defining the race guide surfaces. The thrust and radial bearings are carried in a cartridge which mounts in a yoke connectable to a crane gantry by support pins at first and second points of attachment. Disposition of the bearing cartridge in the yoke is such that the centerline of the support pins coincides with the centerline of the spherical radial bearing. The bearing cartridge is fitted onto a vertical shaft fixed in the upper end of the pedestal. The crane gantry attached to the yoke is rotational with respect to the pedestal, and is rotationally driven by a crane slewing mechanism including a spur gear fixed to the upper end of the pedestal, and a drive mechanism mounted to the gantry, including a planetary gear arrangement for engaging the spur gear.

27 Claims, 5 Drawing Figures

PEDESTAL CRANE MOUNTING SYSTEM

This is a continuation of application, Ser. No. 348,028, filed Feb. 11, 1982, now abandoned.

BACKGROUND OF THE INVENTION

The present invention relates to a mounting system for a pedestal crane having a rotational crane gantry.

A pedestal crane has a revolving gantry including a boom mounted on a support pedestal. A mounting system for mounting the gantry to the pedestal typically includes a bearing assembly which provides for rotation of the gantry about the pedestal and transmits to the support pedestal forces imposed upon the crane gantry by loading of the boom.

Pedestal crane mounting systems have utilized thrust and radial bearings. In some known systems, the thrust bearing is of a planar, circular configuration and made of a nylon material. The radial bearing is similar to the thrust bearing, also being of a planar, rectangular configuration and made of a nylon material. An example of this type of pedestal crane mounting system is that shown in U.S. Pat. No. 4,184,600, issued to Goss et al. on Jan. 22, 1980.

Another pedestal crane mounting system heretofore used includes a cylindrical bushing, preferably of brass, carried on a support column extending upwardly from the end of the pedestal. The mounting system further includes first and second arcuate sections disposed in spaced-apart relation above the bushing to provide vertical support of the crane gantry. Rollers are also mounted on the crane gantry to facilitate rotation of the gantry abut the pedestal. An example of this type of pedestal crane mounting system is that shown in U.S. Pat. No. 4,061,230, issued to Goss et al. on Dec. 6, 1977.

In yet another pedestal crane mounting system heretofore used, there is utilized a bearing assembly having an inner race fastened to the support pedestal, an outer race secured to the crane gantry and three sets of rollers inserted between the races. The three sets of rollers include two sets providing upper and lower thrust bearings and one set providing a radial bearing. An example of this type of pedestal crane mounting system is that shown in U.S. Pat. No. 4,216,870, issued to Bonneson et al. on Aug. 12, 1980.

With pedestal crane mounting systems of the foregoing types, removal of the bearing assembly for inspection or replacement is difficult. Accordingly, there is a need for an improved pedestal crane mounting system providing for the inspection and replacement of the bearings in a simple and easy operation.

SUMMARY OF THE INVENTION

Recognizing the need for an improved pedestal crane mounting system to mount a crane gantry for rotation about a support pedestal, a feature of the present invention is the provision of a bearing cartridge carrying a thrust bearing and a radial bearing. The bearing cartridge is for removable placement on a vertical shaft mounted on the upper end of the support pedestal. A yoke attachable to the crane gantry and secured to, but detachable from, the bearing cartridge provides an interconnection between the bearing cartridge and a crane gantry. The crane gantry is thereby supported on and rotational about the support pedestal.

This mounting structure facilitates bearing removal for inspection or replacement in that the yoke may be detached from the bearing cartridge and permitted to become directly supported by the pedestal. Detachment of the yoke from the bearing cartridge removes the weight of the crane gantry from the bearing cartridge and permits it to be removed from the vertical shaft for inspection.

Suitably, the yoke is detachably secured to the bearing cartridge by bolts which may be progressively loosened to lower the yoke onto the pedestal.

To facilitate centering of the yoke with respect to the vertical shaft, for bearing cartridge removal, a conical surface segment is formed on the underside of the yoke. A complementary or matching conical surface segment is provided beneath the yoke onto which the yoke conical surface segment can be placed.

The yoke is suitably attachable to the crane gantry at first and second points of attachment. The means of attachment may, for example, be pin connections. The yoke may suitably comprise first and second oppositely-extending arms, which attach at the outer end to the crane gantry. Furthermore, the yoke may further comprise a hub from which the arms extend and into which the bearing cartridge is insertable.

As yet another feature of the present invention, the radial bearing is positioned such that the centerline of the bearing is in alignment with the points of attachment of the yoke to the crane gantry, thereby eliminating radial loading of the thrust bearing.

Another feature of the present invention is the provision of a crane mounting system in which the thrust bearing and the radial bearing are roller-type bearings with spherical upper and outer races, respectively. Preferably, the upper race of the thrust bearing and the outer race of the radial bearing have internal concave spherical guide surfaces for the bearing rollers. Furthermore, the generatrices of the spherical guide surfaces of the upper race of the thrust bearing and the outer race of the radial bearing curve around a common point of origin.

Further in accordance with the present invention, a crane slewing mechanism embodying the mounting system is provided in which a driven element, for example, a spur gear is mounted atop the upper end of the pedestal and fixed in position thereon concentrically with respect to the fixed, vertically-extending shaft onto which the bearing cartridge is placed. A drive mechanism, including a prime mover and a drive element, for example, a planetary gear arrangement, to engage the driven element, is mounted on the crane gantry. Operation of the prime mover results in rotational movement of the crane gantry with respect to the pedestal.

These and other features and aspects of the present invention will be described more completely in the detailed description which follows.

BRIEF DESCRIPTION OF THE DRAWINGS

A written description setting forth the best mode presently known for carrying out the present invention, and of the manner of implementing and using it, is provided by the following detailed description of a preferred embodiment which is illustrated in the attached drawings wherein.

DESCRIPTION OF AN ILLUSTRATIVE EMBODIMENT

Figure 1:
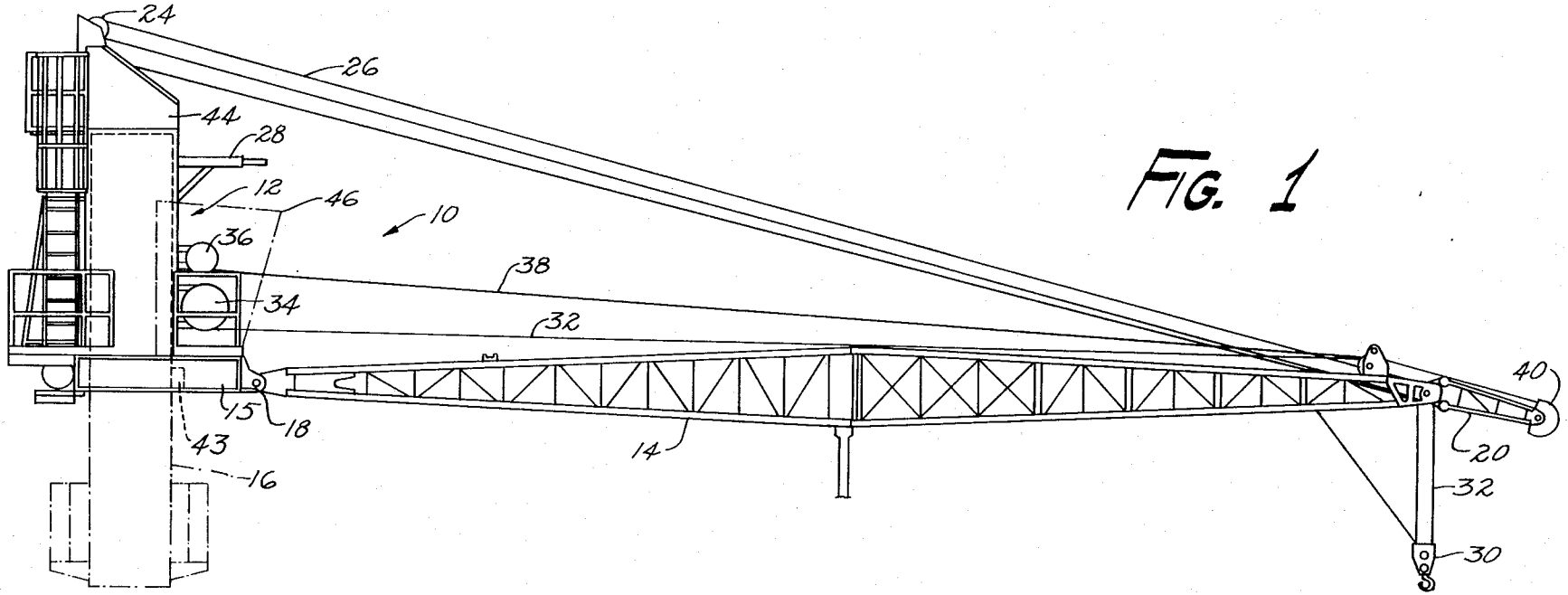
FIG. 1 is an elevational view of a pedestal crane illustrating a crane gantry supported on a pedestal.
Figure 2:
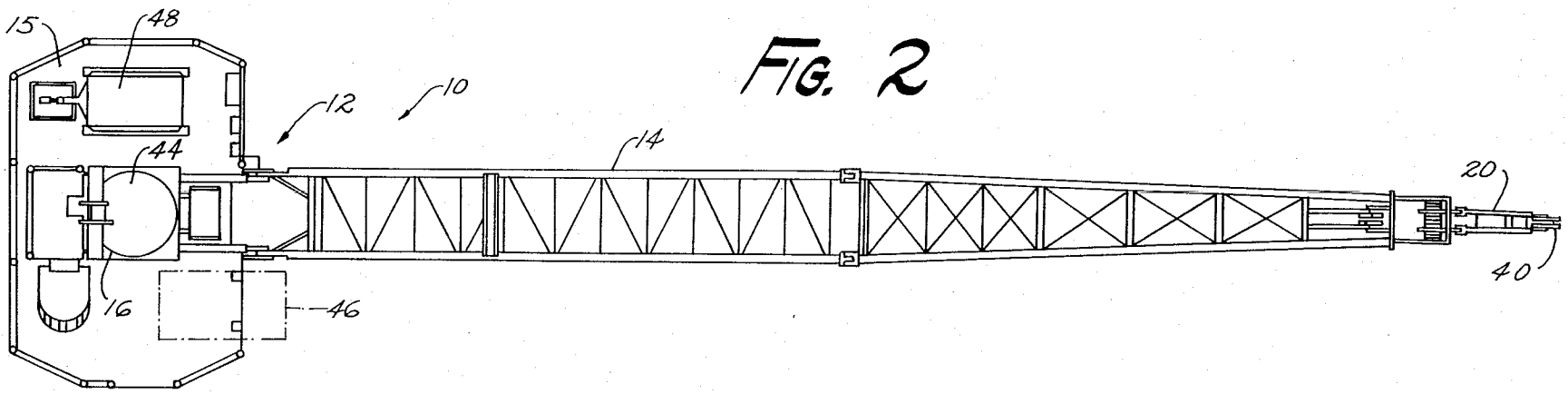
FIG. 2 is a plan view of the pedestal crane shown in FIG. 1.

Referring first to FIGS. 1 and 2 of the drawings, a pedestal crane 10 includes a crane gantry 12 having a boom 14 affixed thereto and a pedestal 16 on which the crane gantry is mounted. Crane gantry 12 is mounted on pedestal 16 by a crane mounting system which supports the crane gantry and provides for rotation of the crane gantry about the pedestal.

Boom 14 is pivotally connected to crane gantry main frame 15 by pin connection 18 providing for movement of the boom in a vertical plane. Suitably, boom 14 is of a lattice type construction comprising tubular steel. Boom 14 may be of any length; however, in most instances, a boom length of 50 feet is acceptable. Boom 14 may also be provided with variable length extension sections to extend the length of the boom. Boom 14 may also include an offset sheave extension section 20.

Boom 14 is raised and lowered in the vertical plane about pin connection 18 by means of a boom hoist 22, operating through upper works including sheave 24 to reel in and pay out boom hoist line 26. A boom backstop 28 is provided on crane gantry 12 to limit the extent to which boom 14 can be vertically raised.

Loads are picked up and moved by the pedestal crane by means of a traveling block and hook 30 connected to a main hoist line 32. Main hoist 34 on the crane gantry reels in and pays out main hoist line 32 to raise and lower traveling block and hook 30. An auxiliary hoist 36 and hoist line 38 are also provided. An auxiliary hook (not shown) may be utilized as a second means of picking-up a load. Auxiliary hoist line 38 extends to and moves over sheave 40 on offset extension 20.

A complete crane gantry structure 12 includes the main frame 15 and a vertically-extending column 44. Main frame 15 has boom 14 pinned thereto at connection 18 and has mounted thereon boom hoist 22. Sheave 24 is mounted at the upper end of column 44, and boom backstop 28 and auxiliary hoist 36 are mounted to the side of column 44. To facilitate rotation of crane gantry 12 about pedestal 16, frame 15 is further provided with rollers 43. These rollers contact the midsection of pedestal 16 and roll over the surface thereof.

Optionally, an operator's cab 46 may be provided on crane main frame 15.

As shown in the plan view of FIG. 2, frame 15 extends laterally of column 44 providing a platform with floor space and walkways around cab 46 and the machinery mounted thereon. Machinery on the main frame includes an engine 48 providing power for a hydraulic system for operating hoists 22, 34, and 36. Alternatively, of course, the hoists could be electrically operated, and the engine could provide power to an electrical generator located on the main frame. Additionally, a full instrument panel is provided for the operator, and preferably located within operator's cab 46 on the main frame.

The main frame 15 is suitably of an all-welded, deep-box construction. The main hoist is suitably a planetary reduction system enclosed within an oil-filled drum. A fixed displacement gear pump suitably powers individual reversible gear motors on the drum. The boom hoist is a planetary reduction system enclosed within an oil-filled drum. A fixed displacement gear pump powers a reversible gear motor on the drum. Power controlled load lowering is utilized on both the drum of the main hoist and the boom hoist. Furthermore, an automatic safety lock pawl is preferably provided on the boom hoist.

Figure 3:
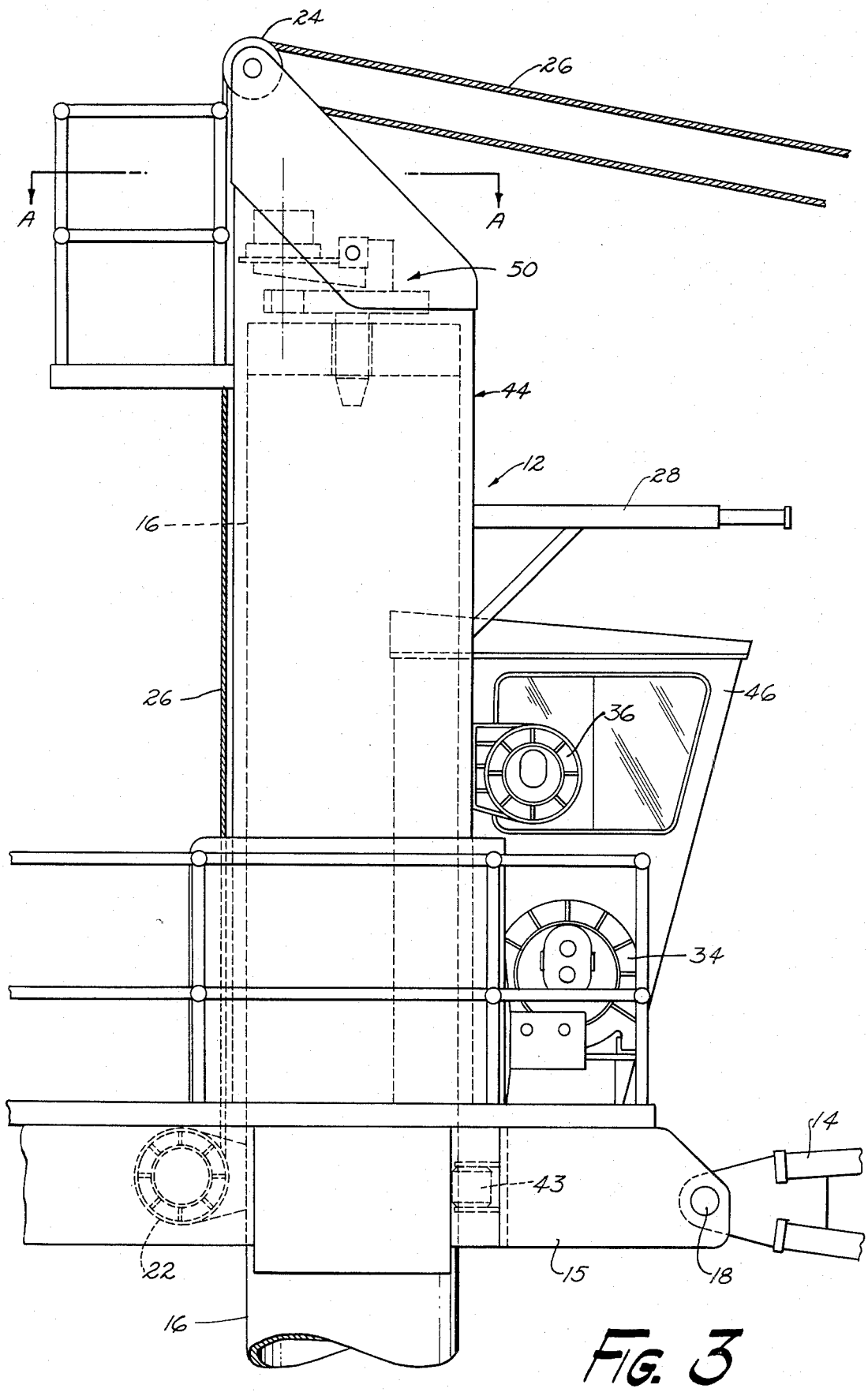
FIG. 3 is a detailed, close-up elevational view of the pedestal crane in FIG. 1, particularly illustrating the crane slewing drive mechanism for rotating the crane gantry about the pedestal.

Referring now to FIG. 3, the crane gantry 12 and pedestal 16 are shown in more detail. As shown by the dashed lines, pedestal 16 extends through frame 15 and into column 44. Mounted within column 44 and at the top of pedestal 16 is a crane mounting system and crane slewing mechanism 50. The crane slewing mechanism suitably comprises a fixed displacement gear pump powering a reversible motor with planetary and spur gear reduction. A swing brake is also mounted on the gear reduction input shaft. The gantry is connected to the pedestal by a mounting system which includes bearings for providing rotation of the gantry relative to pedestal 16.

Figure 4:
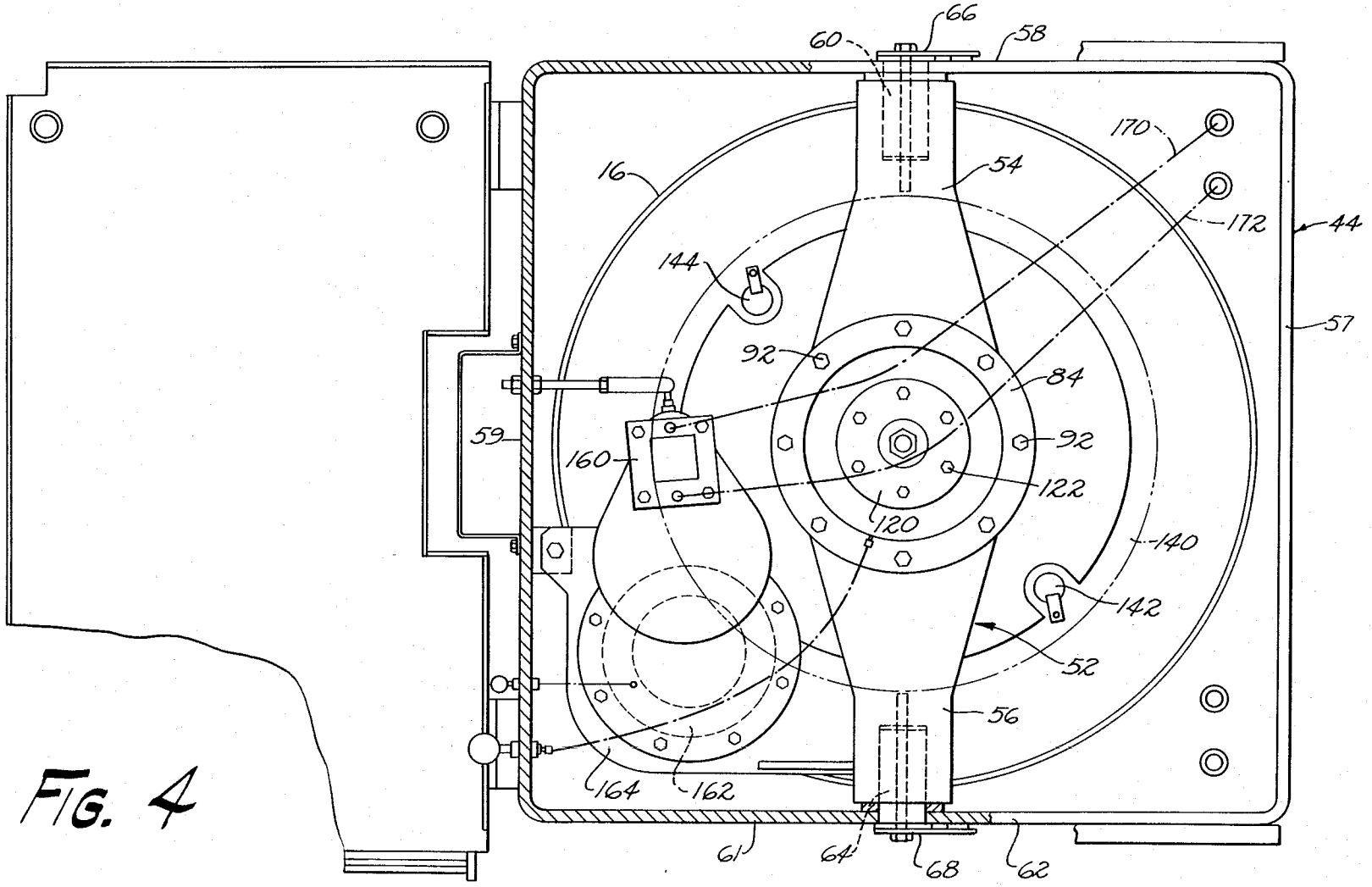
FIG. 4 is a plan view of a portion of the crane gantry and the crane mounting assembly, particularly illustrating the interconnection of the crane gantry and yoke.

Referring next to FIG. 4, there is shown in a plan, sectional view, gantry column 44 and portions of the crane mounting system and crane slewing mechanism 50 shown in FIG. 3. As will be appreciated from the view in FIG. 4, gantry column 44 is of a generally square configuration, and pedestal 16 is of a generally cylindrical configuration.

Interconnection between the crane mounting system and the gantry column 44 is by yoke 52. As shown, in the embodiment being described herein, yoke 52 has first and second laterally-extending arms 54 and 56. The yoke arms extend opposite one another toward opposing sidewalls of rectangular gantry column 44. Connection between each yoke arm and the respective sidewall of the gantry column is by a yoke pin. For example, yoke arm 54 connects to sidewall 58 by yoke pin 60, and yoke arm 56 connects to sidewall 62 by yoke pin 64. A locking bar 66 is further provided on yoke pin 60 to secure the pin; and similarly, a locking bar 68 is provided for yoke pin 64.

Figure 5:
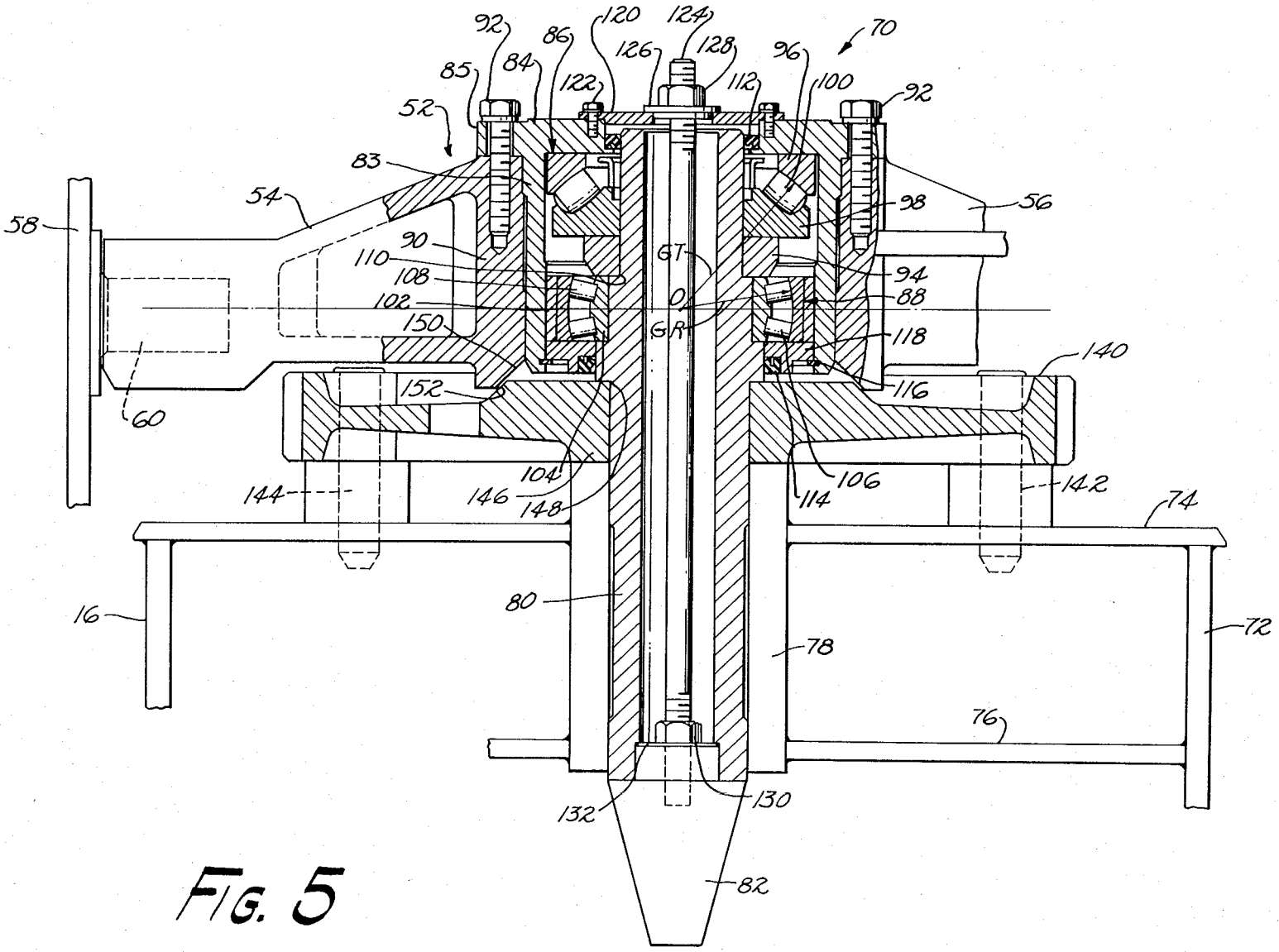
FIG. 5 is a cross-sectional view of the pedestal crane mounting assembly, for mounting the crane gantry on a pedestal.

Yoke 52 and crane gantry column 44 are rotational about pedestal 16 by reason of the bearing cartridge of the crane mounting system shown in FIG. 5. Referring now to FIG. 5, there is shown in cross-section crane mounting system 70, for providing vertical and radial support of the complete crane gantry structure 12 on pedestal 16, and for further providing rotational movement of the crane gantry structure about the pedestal.

The upper end of pedestal 16 is shown in FIG. 5. In addition to the cylindrical wall 72, the upper end of pedestal 16 includes upper and lower platforms 74 and 76. Extending vertically through horizontal platforms 74 and 76, and positioned concentrically within the cylindrical wall 72, is a sleeve 78. As shown, sleeve 78 extends for a distance above the top surface of horizontal platform 74.

A shaft 80 to be held in vertical, fixed position on pedestal 16 is inserted within the internal opening of sleeve 78. Shaft 80 has a temporary stabbing guide 82 formed on the lower end to facilitate insertion of the shaft within the sleeve. Suitably, shaft 80 is press-fitted within sleeve 78. Shaft 80 extends upwardly from the upper end of the pedestal and is positioned concentrically with respect to the pedestal. Suitably, shaft 80 has a hollow interior, thereby making it a tubular shaft.

Furthermore, the exterior surface of shaft 80 is machined to provide sections of varying diameter, so as to form shoulders thereon at certain locations along its length.

A bearing cartridge 84 having a thrust bearing 86 and a radial bearing 88 is placed on the upper end of shaft 80. Bearing cartridge 84 is also secured to yoke 52. Specifically, bearing cartridge 84 has a generally cylindrical housing 83 which is inserted within a central interior opening in the hub portion 90 of yoke 52. The bearing cartridge is secured to yoke 52 by means of a number of bolts 92 extending through bolt holes in flange 85 of housing 83 and engaging threads in threaded openings in hub 90.

In bearing cartridge 84, thrust bearing 86 is positioned above radial bearing 88, and separated therefrom by a spacer 94. Thrust bearing 86 includes an upper race 96, a lower race 98, and a plurality of rollers 100 in-between the upper and lower races. The upper race of thrust bearing 86 is of a spherical configuration. That is, the guide surface for the rollers is of an internal concave spherical configuration. The generatrix GT for the spherical surface curves about a point of origin O.

Radial bearing 88 includes an outer race 102 and an inner race 104. The bearing has first and second sets of rollers 106, and 108. The outer race of radial bearing 88 is of a spherical configuration. That is, the guide surface for the rollers is of an internal concave spherical configuration. The generatrix GR for the spherical surface curves about a point of origin O.

Since the spherical roller guide surfaces of the upper race of thrust bearing 86 and the outer race 102 of radial bearing 88 are defined with respect to a common origin, the spherical bearings share a coincidental point of origin or spherical center. This arrangement is significant in that it permits slight misalignment of the bearing cartridge without detrimental effect to the rolling contact of the rollers of the bearings in their respective races.

As also shown in FIG. 5, radial bearing 88 is positioned such that the centerline of the spherical surface segment defining the outer race of the radial bearing is in alignment and coincidental with the centerline of the yoke pins. This places the point of origin 0 of the spherical radial bearing outer race in alignment with the yoke pins. This is significant in that radial loading of the thrust bearing is eliminated.

Vertical support of the crane gantry on the pedestal is provided by thrust bearing 86. As shown in FIG. 5, thrust bearing 86, spacer 94 and the vertical shaft 80 are in an abutting relationship, with the spacer 94 being supported on shoulder 110 formed on vertical shaft 80. There is further provided upper and lower oil seals 112 and 114 protecting the bearings against the introduction of foreign material and loss of lubricating oil. There is further provided a retainer ring 116 at the lower end of bearing cartridge 84, which retains spacer 118 for the outer race of radial bearing 88 in position.

An end cap 120 is positioned over a central opening in the bearing cartridge held in place by a plurality of bolts 122. End cap 120 has a central opening therein to permit a threaded rod 124 to pass therethrough and extends through the bore opening in vertical shaft 80. A washer 126 overlies the central opening in end cap 120, and a nut 128 threaded on rod 124 is tightened down against the washer to hold it securely over the opening in the end cap. The lower end of threaded rod 124 is threaded into the stabbing guide 82 with a nut 130 having a washer 132 secured thereto.

As will be appreciated, with the arrangement shown in FIG. 5 and described above, yoke 52 and the crane gantry pinned thereto is rotational about pedestal 16. Furthermore, the weight of the crane gantry is transmitted through thrust bearing 86 and vertical shaft 80 to pedestal 16. Radial loading of the crane mounting system, which occurs upon lifting of a load secured to the crane boom is applied to radial bearing 88.

With continued reference to FIG. 5, there is further provided on pedestal 16 and fixed in position thereon, a spur gear 140. This gear is horizontally disposed and is fixed against rotation by anchoring pins 142 and 144. Anchoring pins 142 and 144 extend through openings in gear 140 and into openings in platform 74 of pedestal 16. Gear 140 has a centralized opening permitting it to be placed on vertical shaft 80. Additionally, gear 140 has a hub position 146 which is adapted to abut the upper end of sleeve 78 and provide vertical support to shoulder 148 formed on vertical shaft 80.

As pointed earlier, the crane mounting system 70 of the present invention, of which the structure diagrammed and described herein is an exemplary embodiment, facilitates removal of the bearings for inspection or replacement by permitting the crane gantry and attached yoke to be lowered with respect to bearing cartridge 84 and detached therefrom. This may be accomplished by progressively loosening bolts 92 which secure the bearing cartridge to the hub of yoke 52. When bolts 92 have been sufficiently loosened, a lower surface 150 on yoke 52 will come to rest and be supported on an upper surface 152 of gear 140. With the weight of the crane gantry being fully supported upon pedestal 16, bearing cartridge 84 and the bearings contained therein may be removed as an entire unit from within the yoke hub and from around vertical shaft 80. Nut 128 will, of course, have to be removed.

In the illustrative embodiment shown in FIG. 5, surfaces 150 and 152 are preferably conical surfaces having the same slope or bevel. Matching conical surfaces serve to concentrically position the yoke hub with respect to vertical shaft 80 and facilitate removal of the bearing cartridge.

After the bearings have been inspected or replaced, the bearing cartridge is reinserted in the yoke hub and bolts 92 are progressively tightened to return the crane gantry to its operational position.

Returning now to FIG. 4, in the plan view shown therein, spur gear 140 and pins 142, 144 are in view. Gear 140, of course, is secured to pedestal 16, but may nevertheless be viewed as a driven element. In order to provide rotation of the crane gantry structure about pedestal 16, therefore, some motive means must be mounted on the crane gantry for engaging the driven element. This means is provided in the form of a reversible hydraulic motor having a gear reduction box 162. The reduction gear box and spur gear 140 provide a multiple-stage gear reduction. Gear box 162 is securely mounted to yoke 52 by an integral bracket 164. Hydraulic fluid to motor 160 is provided by hose assemblies 170, 172. Hydraulic motor 160 is, of course, mounted to reduction gear box 162.

The foregoing description of the invention has been directed to a particular embodiment for purposes of explanation and illustration. It will be apparent, however to those skilled in this art that many modifications and changes in the structure of the illustrated embodiment may be made without departing from the essence of the invention. For example, the means for securing the bearing cartridge to the yoke may be something other than bolts. The means need only provide for securing the yoke to the bearing cartridge and permit detachment for lowering of the yoke relative to the bearing cartridge. Also, although placement of the gear driven element atop the pedestal is an expedient arrangement, the gear may be disposed otherwise, for example, it may be recessed into the upper end of the pedestal. By reason of the placement of the gear driven element atop the upper end of the pedestal, it is inexpedient to permit the yoke to be lowered onto the gear, and be supported thereon for bearing cartridge removal; however in the event the gear is disposed otherwise than is shown in the illustrated embodiment, the yoke could be allowed to come to rest upon some other surface or attachment to the pedestal. These, and other modifications of the illustrated embodiment, as well as other embodiments of the invention, will be apparent to those skilled in this art. It is the applicant's intention in the following claims to cover all equivalent modifications and variations as fall within the scope of the invention.

What is claimed is:

1. In a crane having a vertical pedestal with an upper end and a gantry structure with a boom attached thereto, mounting and slewing apparatus, comprising:

a fixed vertical shaft extending upwardly from the upper end of the pedestal;

a yoke connectable to a gantry structure;

a bearing cartridge supported on said vertical shaft, for providing rotation of the yoke and a connected crane gantry structure about the pedestal; and means for supporting said yoke and attached crane gantry structure relative to the bearing cartridge, and for lowering the yoke and attached crane gantry structure to rest in support upon the upper end of the pedestal to permit removal of the bearing cartridge.

2. The apparatus of claim 1 wherein said yoke has a hub portion with a centralized opening; said bearing cartridge includes a flanged housing insertable within the opening in the hub of the yoke; and said yoke supporting and lowering means includes a plurality of bolts passing through openings in the bearing housing flange and received in threaded openings in the hub of said yoke.

3. The apparatus of claim 1 further comprising a drive element mounted in fixed position on the upper end of the pedestal and having an upper surface.

4. The apparatus of claim 3 wherein said yoke includes a lower surface for coming to rest and being supported on the upper surface of said drive element.

5. The apparatus of claim 3 further comprising:

means mounted on said gantry and engaging said drive element, for driving the gantry structure in rotation about the pedestal.

6. The apparatus of claim 1 wherein said yoke is connected to the gantry at first and second points of attachment; and wherein:

said bearing cartridge includes a radial bearing having an outer race with a spherical guide surface and positioned with the centerline of the outer race in alignment with the points of attachment of the yoke to the gantry; and said bearing cartridge includes a thrust bearing having an upper race with a spherical guide surface.

7. The apparatus of claim 5 wherein:

said drive element is a spur gear; and said driving means includes a motor and a gear box for engaging the spur gear.

8. The apparatus of claim 6 wherein:

the generatrices of the spherical guide surfaces of the upper race of the thrust bearing and the outer race of the radial bearing curve about a common point of origin.

9. The apparatus of claim 3 wherein:

said common point of origin lies in alignment with the centerline of the outer race of the radial bearing.

10. The apparatus of claim 6 wherein:

said yoke comprises first and second outwardly and oppositely extending arms; and said points of attachment are at the ends of the yoke arms.

11. The apparatus of claim 10 further comprising:

first and second pin connections for making the attachment of the yoke arms to the gantry.

12. The apparatus of claim 6 wherein:

said thrust bearing is disposed above and spaced-apart from said radial bearing.

13. Apparatus for mounting a crane gantry structure to a pedestal, comprising:

a shaft for mounting in a vertical orientation on the upper end of a crane pedestal;

a yoke for attachment to a crane gantry;

said yoke having a hub portion with a centralized opening therethrough;

a bearing cartridge to be supported on said vertical shaft, providing rotation of the crane gantry structure about the pedestal;

said bearing cartridge including a housing removably insertable within the opening in the hub of said yoke; and means for supporting said yoke and attached crane gantry structure relative to the bearing cartridge, and for lowering the yoke and attached crane gantry structure to rest in support upon the upper end of the pedestal to permit removal of the bearing cartridge.

14. The apparatus of claim 13 wherein said bearing cartridge includes thrust and radial bearings.

15. The apparatus of claim 14 wherein:

said thrust bearing includes upper and lower bearing races and a plurality of rollers in-between;

said upper race forming an internal concave spherical guide surface for said rollers;

said radial bearing includes inner and outer bearing races and a plurality of rollers in-between;

said outer race forming an internal concave spherical guide surface for said rollers.

16. The apparatus of claim 14 wherein:

said thrust bearing is disposed above said radial bearing;

said radial bearing is disposed in position along said shaft such that the centerline of the radial bearing race is in alignment with the points of attachment of the yoke to the crane gantry.

17. A pedestal crane, comprising:

a vertical support pedestal;

a crane gantry structure having a boom affixed thereto;

a vertical shaft mounted in fixed position on the upper end of said pedestal;

a yoke having a hub portion with a centralized opening therethrough, and first and second attachment arms extending radially outward from the hub on opposite sides thereof;

a first pin connection for attaching a first of said yoke to said crane gantry;

a second pin connection for attaching the second of said yoke arms to said crane gantry;

a bearing cartridge including a housing removably inserted in the hub opening and having a flange thereon in abutment with the yoke hub, and thrust and radial bearings contained in the housing and placed on said shaft, for supporting the yoke and attached crane gantry for providing for rotation of the crane gantry structure about the pedestal; and means for supporting said yoke and attached crane gantry structure relative to the bearing cartridge, and for lowering the yoke and attached crane gantry structure to rest in support upon the upper end of the pedestal to permit removal of the bearing cartridge.

18. The apparatus of claim 17 wherein:

said thrust bearing includes upper and lower bearing races and a plurality of rollers in-between;

said upper race forming an internal concave spherical guide surface for the rollers;

said radial bearing including inner and outer bearing races and a plurality of rollers in-between;

said outer races forming an internal concave spherical guide surface for the rollers.

19. The apparatus of claim 18 wherein the generatrices of the guide surfaces of the thrust bearing upper race and the radial bearing outer race curve around a common point of origin.

20. The apparatus of claims 18 or 19 wherein the radial bearing is disposed with the centerline of the outer race in alignment with the centerline of said pin connections.

21. The apparatus of claim 17 wherein the pedestal includes a horizontal platform on the upper end having a vertical sleeve disposed therein for receiving said vertical shaft.

22. The apparatus of claim 17 wherein said supporting and lowering means comprises a plurality of bolts extending through bolt holes in the flange on the bearing cartridge housing and being engaged in threaded bolt holes in the yoke hub.

23. The apparatus of claim 17 further comprising a gear fixed in position on said vertical shaft and disposed beneath said yoke hub, and means mounted to the crane gantry for engaging the gear and driving the gantry in rotation.

24. The apparatus of claim 17 further comprising means on the upper end of the pedestal for defining a surface on which said yoke is supported upon being lowered from said bearing cartridge.

25. A pedestal crane, comprising:

a vertical support pedestal;

a crane gantry structure having a boom affixed thereto;

a vertical shaft mounted in fixed position on the upper end of said pedestal;

a bearing cartridge having a housing containing thrust and radial bearings placed on said vertical shaft;

a yoke attached to said crane gantry;

means for detachably connecting said yoke to said bearing cartridge housing, and providing for controlled lowering of the yoke relative to the housing during detachment; and means on the upper end of the pedestal for defining a surface on which said yoke is supported upon being detached from said bearing cartridge housing.

26. Apparatus for mounting a crane gantry structure to a pedestal, comprising:

a shaft for mounting in a fixed, vertical orientation on the upper end of a crane pedestal;

a yoke for attachment to a crane gantry;

a bearing cartridge having a radial bearing and a thrust bearing in a unitary assemblage, for providing rotation of the yoke about the shaft;

said bearing cartridge being mountable on said shaft and supported thereon; and means for detachably connecting the yoke to the bearing cartridge;

said detachable connecting means supports the yoke relative to the bearing cartridge and provides for lowering of the yoke to rest in support upon the upper end of the pedestal to permit removal of the bearing cartridge from the shaft.

27. The apparatus of claim 26 wherein:

said radial bearing has an outer race with a spherical guide surface and positioned with the centerline of the outer race in alignment with the points of attachment of the yoke to the gantry; and said thrust bearing has an upper race with a spherical guide surface.

* * * * *

UNITED STATES PATENT AND TRADEMARK OFFICE

CERTIFICATE OF CORRECTION

PATENT NO. : 4,513,869

DATED : April 30, 1985

INVENTOR(S) : William E. Goudy, deceased

It is certified that error appears in the above-identified patent and that said Letters Patent is hereby corrected as shown below:

Column 8, line 10 (claim 9), delete "3" and insert --8--.

Signed and Sealed this

*Third* Day of *September 1985*

[SEAL]

*Attest:*

DONALD J. QUIGG

*Attesting Officer* *Acting Commissioner of Patents and Trademarks - Designate*